United States Patent [19]

Taniguchi et al.

[11] Patent Number: 4,814,032

[45] Date of Patent: Mar. 21, 1989

[54] METHOD FOR MAKING NONWOVEN FABRICS

[75] Inventors: Masahiko Taniguchi; Shigeru Goi, both of Moriyama; Taizo Sugihara, Omihachiman, all of Japan

[73] Assignee: Chisso Corporation, Osaka, Japan

[21] Appl. No.: 125,553

[22] Filed: Nov. 25, 1987

[30] Foreign Application Priority Data

Nov. 28, 1986 [JP] Japan ..... 61-283249

[51] Int. Cl.[4] ..... D04H 3/14

[52] U.S. Cl. ..... 156/167; 264/103; 264/168; 264/171

[58] Field of Search ..... 264/103, 168, 171, 518; 156/167

[56] References Cited

U.S. PATENT DOCUMENTS

| | | | |
|---|---|---|---|
| 3,457,338 | 7/1969 | Fefevre | 264/103 |
| 3,607,509 | 9/1971 | Schrenk | 156/167 |
| 3,718,534 | 2/1973 | Okamoto et al. | 264/171 |
| 4,189,338 | 2/1980 | Ejima et al. | 264/168 |
| 4,367,113 | 1/1983 | Karim et al. | 264/171 |
| 4,469,540 | 0/0000 | Furukawa et al. | 156/62.4 |
| 4,500,384 | 2/1985 | Tomioka et al. | 156/296 |
| 4,552,603 | 11/1985 | Harris, Jr. et al. | 156/167 |

FOREIGN PATENT DOCUMENTS 2114581 of 0000 United Kingdom .

*Primary Examiner*—Jan H. Silbaugh
*Assistant Examiner*—Allan R. Kuhns
*Attorney, Agent, or Firm*—Oblon, Fisher, Spivak, McClelland & Maier

[57] ABSTRACT

A method for making nonwoven fabrics includes the steps of preparing heat-adhesive composite fibers including first and second components, forming a web of the composite fibers alone or containing at least 20% by weight of the composite fibers, and heat-treating the web at a temperature higher than the melting point of the second component but lower than the melting point of the first component, while increasing the temperature of the web at a rate of temperature rise of 100° C./30 seconds and more. The first component is polypropylene having specific physical values with respect to density, isotactic pentad ratio, pentad ratio having two different kinds of configurations, and melt flow rate, and the second component is a polymer composed mainly of polyethylene.

9 Claims, No Drawings

METHOD FOR MAKING NONWOVEN FABRICS

BACKGROUND OF THE INVENTION

1. Field of the Invention

The present invention relates to a method for making a nonwoven fabric by the heat treatment of a web comprising heat-adhesive composite fibers, in which sufficient bulk is achieved under such treating conditions that a pressure is applied to the web during the heat treatment.

2. Statement of the Prior Art

Heretofore, there has been known a method for making porous nonwoven fabrics by the heat treatment of a web, at least a part of which is composed of heat-adhesive composite fibers containing as the composite components fiber-formable polymers having different melting points, to head-bond the fibers together. Among others, the use of heat-adhesive composite fibers containing as the composite components polypropylene and other polymer having a lower melting point than that of the polypropylene has been known from long ago. With such heat-adhesive composite fibers, however, a problem arises that the bulk of a nonwoven fabric obtained therefrom is lower than that of the web before the heat treatment. This is because they are generally heat-bonded together with large shrinkage, since latent crimps are developed by the heat treatment in addition to the original three-dimensional crimps which have already been developed.

To solve such a problem, it has been known to anneal the heat-adhesive composite fibers prior to obtaining a nonwoven fabric therefrom, for the pre-development of latent crimps and, then, make a nonwoven fabric. In this case, however, it is difficult to control the number of crimps. In addition, the processability of the web and the bulk of the nonwoven fabric are largely affected by too large or small a total number of crimps after annealing. With such a method, therefore, difficulty is practically encountered in eliminating the above-mentioned problem.

Incidentally, Japanese Patent Laid-Open No. 58-23951 discloses a method for making bulky nonwoven fabrics, using heat-adhesive composite fibers having three-dimensional crimps but not substantially latent crimps, which are obtained by specifically limiting the Q value of polypropylene which is one of the composite components and stretching conditions. In the method disclosed, however, since the heat treatment is carried out with no application of any substantial pressure to the webs, the obtained nonwoven fabrics become bulky. With this method, however, it is impossible to obtain sufficiently bulky nonwoven fabrics, when a dryer of the type that applies pressure to webs at the time of heat treatment is used, such as a suction dryer which is now enjoying increasing use.

SUMMARY OF THE INVENTION

In view of the foregoing problems, a main object of the present invention is to provide means which makes it possible to obtain sufficiently bulky nonwoven fabrics, even when heat treatment is carried out under such conditions that a pressure is applied to webs.

More specifically, according to the present invention, there is provided a method for making nonwoven fabrics which comprises the steps:

melt-spinning first and second components to obtain heat-adhesive composite fibers and crimping thereafter, said first component being polypropylene having a density of 0.905 or higher, and having a boiling n-heptan-insoluble part whose isotactic pentad ratio is 0.950 or higher and whose pentad ratio having two different kinds of configurations is 0.002 or lower, and said second component being a polymer composed mainly of polyethylene, said first and second components being of the side-by-side or sheath-core arrangement in which said second component is formed on at least a part of the surfaces of said fibers in a lengthwise continuous manner, and said first component showing a melt flow rate of 3 inclusive to 20 exclusive before melt-spinning and a difference of within 10 between the melt flow rates before and after melt-spinning forming a web consisting of said composite fibers alone or containing at least 20% by weight of said composite fibers; and heat-treating said web at a treatment temperature equal to or higher than the melting point of said second component but lower than the melting point of said first component, while increasing the temperature of said web at a rate of 100° C./30 seconds and more.

DETAILED DESCRIPTION OF THE INVENTION

The present invention will now be explained in more detail.

The polypropylene used as the first component in the present invention may be prepared by the method described in Japanese Patent Laid-Open No. 58-104907. More specifically, an organic aluminium compound or a reaction product of an organic aluminium compound with an electron donor is first allowed to react with titanium tetrachloride to obtain a solid product (I). The solid product (I) is then allowed to react with an electron donor and an electron acceptor to obtain a solid product (II). To obtain the desired polypropylene, propylene may be polymerized in the presence of a catalyst combination of the solid product (II) with an organic aluminium compound and an aromatic carboxylate (III) and in a said aromatic carboxylate (III) to said solid product (II) molar ratio of 0.2–1.00.

By the isotactic pentad ratio is meant an isotactic ratio expressed in terms of pentad units in the molecular chain of polypropylene measured by the method using $^{13}$C-NMR presented in Macromolecules 6, 925 (1973) by A. Zambelli et al. Hence, the isotactic pentad ratio means the ratio of five propylene monomer units which are successively isotactically bonded in the molecular chain. The pentad ratio having two different kinds of configurations means the ratio of five monomer units successively bonded in the molecular chain wherein three monomer units have a common configuration and the remaining two have an opposite configuration.

Referring to the polypropylene used in the present invention, the isotactic pented raio ($P_o$) of its boiling n-heptane-insoluble part is equal to or higher than 0.950, and the pentad ratio ($P_2$) having two different kinds of configurations is equal to or lower than 0.002. Even when using heat-adhesive composite fibers containing as the first component a polypropylene with $P_o$ being below 0.950, it is impossible to obtain any bulky nonwoven fabric, since its bulk is reduced by the heat treatment for making it. It is also impossible to obtain any bulky nonwoven fabric, even when using heat-adhesive composite fibers containing as the first component a polypropylene with $P_2$ exceeding 0.002.

The polypropylene used in the present invention has preferably a density equal to or higher than 0.905 with no application of any extraction treatment at all, and has preferably a density equal to or higher than 0.910. It is also impossible to obtain any bulky nonwoven fabric, even when heat-adhesive composite fibers containing as the first component a polypropylene with the density being below 0.905 is used.

Before melt-spinning, the polypropylene to be used in the present invention should have a melt flow rate (which may hereinafter be abbreviated as MFR, and is measured by the method to be described later) limited to a range of 3 inclusive to 20 exclusive for the following reasons. When melt-spinning is carried out using a polypropylene with MFR being below 3 as one of the components, it is extremely difficult to carry out composite spinning due to its inferior spinnability. On the other hand, when melt spinning is carried out using a polypropylene with a MFR equal or or more than 20 before spinning, it is impossible to obtain any bulky nonwoven fabric from the web containing the thus obtained composite fibers, even though it has the predetermined ranges of $P_0$, $P_2$ and density.

A difference between the MFRs of the polypropylene before and after melt-spinning should be limited to within 10 for the following reasons. If the MFR difference exceeds 10, it is then impossible to obtain any bulky nonwoven fabric, since, when a web containing the obtained composite fibers is formed into a nonwoven fabric by heat treatment, its bulk is reduced. This cause is considered to be that the MFR of polypropylene is generally increased by heat treatment because of its molcular chain breaking, and when it is increased excessively, the degree of crystallization of polypropylene drops with an increase of the low molecular weight part. In order to limit MFR difference of polypropylene before and after melt-spinning to within 10, the polypropylene may be spun solely to measure its MFRs before and after spinning. Then, a condition under which the MFR difference is limited to within 10 may be selected by such testing. The thus obtained condition is applied as the spinning condition of the first component in composite spinning.

The polypropylene constituting the first component of the heat-adhesive composite fibers used in the present invention has a melting point higher than that of ordinary one by at least 2° C., and shows an extremely high degree of crystallinity. For instance, this is expressed in terms of a measurement obtained on a differential scanning calorimeter (DSC). Moreover, the rate of crystallization of such polypropylene from a molten state is faster than that of usual one, so that the rate of growth and number of nuclear of the spheralites occurred, for instance, are increased. The fact that the polypropylene constituting the first component of the heat-adhesive composite fibers used in the present invention has the aforesaid properties is considered to be the reason that the obtained nonwoven fabric is permitted to become bulky by reducing the decrease in the bulk of the web at the time of heat treatment.

The polyethylene used as the main ingredient of the second component of heat-adhesive composite fibers used in the present invention is a general term for polymers containing ethylene as the main component such as high- or low-density polyethylene, in which not only homopolymers of ethylene but also copolymers of ethylene with propylene, butene-1 or vinyl acetate, e.g., EVA are included. The polymer used as the second component mainly composed of polyethylene may be an ethylene polymer alone, a mixture of such ethylene polymers or a mixed polymer of 50% and more by weight of polyethylene with another polymers such as polypropylene, polybutene-1 or EPR (ethylene-propylene rubber). The melting point of the second component should preferably be lower than that of the first component (polypropylene) by 20° C. and higher. Although not specified, preferable to this end is a polyethylene having a melt index (measured by the method to be described layer) of about 5 to 35 on account of its easy spinnability.

The first and second components may contain various additives usually used for polyolefine fibers such as stabilizers, fillers and pigments, provided that they are fit for the purpose of this invention.

In the heat-adhesive composite fiber of the present invention, it is required that the second component be formed on at least a portion of the fiber surface, preferably the possible widest portion of the fiber surface, in a lengthwise continuous manner. In other words, such as composite fiber is of the side-by-side type comprising the first and second components or the sheath-core type in which the first and second components are used as the core and sheath components, respectively, and may be obtained by the known melt spinning process. Although no special limitation is imposed upon the proportion of both components, it is preferred that the second component amounts to 40 to 70% by weight.

A composite nonstretched yarn of the given composite structure obtained by melt-spinning of the aforesaid first and second components is usually stretched by known stretching methods and apparatus to improve tenacity, touch or feeling, and like factors, thereby developing suitable three-dimensional crimps. But stretching may not necessarily be applied. Such a composite nonstretched yarn may be used as the raw material for nonwoven fabrics by imparting two-dimensional crimps thereto by a crimping machine. Such mechanical crimping may be applied to yarn materials obtained by stretching the composite nonstretched yarns, if required. Obtained in this manner are the heat-adhesive composite fibers (which may hereinafter be called the H heat-adhesive composite fibers so as to distinguish them from what is generally called the heat-adhesive composite fibers in the art) which are the main constitutional element of a web from which a nonwoven fabrc is obtained in accordance with the present invention.

In accordance with the present invention, other fibers to be blended with the H heat-adhesive composite fibers, when a web containing the H heat-adhesive composite fibers is formed into a nonwoven fabric, should not be molten by the heat treatment of the web. In other words, use may be made of any types of fibers which have a melting point higher than the heat-treatment temperature, or which do not suffer degenerations such as carbonization. For instance, one or more of natural fibers such as cotton or wool, regenerated fibers such as viscose rayon, semi-synthetic fibers such as cellulose acetate fibers, synthetic fibers such a polyolefinical fibers, acrylic fibers or polyvinyl alcohol fibers, and inorganic fibers such as glass fibers may optionally be selected for use. The proportion of the H heat-adhesive composite fibers to be blended with other fibers to form a web is 20% or more by weight based on the total weight of the fiber materials. If the H heat-adhesive composite fibers are contained in the web in an amount of 20% by weight, the web may be formed into a bulky nonwoven fabric by a certain adhesive effect from heat treatment, which may satisfactorily be used for the purposes of sound absorbing materials and soundproofing materials. However, the blending proportion of the H heat-adhesive composite fibers should be 30% or more by weight so as to enable nonwoven fabrics to be used in applications where they should generally possess strength. In this case, the effect of the present invention becomes remarkable. The H heat-adhesive composite fibers may be blended with other fibers in a short fiber state or tow state by any suitable method.

The H heat-adhesive composite fibers with or without other fibers may be formed into a web in a suitable form such as a parallel web, cross web, random web or tow web.

The web is then heat-treated at a temperature equal to or higher than the melting point of the second component of the H heat-adhesive composite fibers but lower than the melting point of the first component thereof, whereby a nonwoven fabric is obtained through the melt-adhesion of the second component. In this case, heating should be applied in such a manner that the temperature of the web is increased at a rate of 100° C./30 seconds or higher. If heating is conducted at a rate therebelow, then it is impossible to obtain any bulky nonwoven fabric due to reductions in the bulk of the web. The reason is that when the rate of temperature increase is less than 100° C./30 seconds, there takes place a relaxation of the molecular orientation of the first component polypropylene given at the time of spinning and stretching.

The web may be heat-treated by any one of methods using dryers such as hot-air dryers, suction drum dryers or Yankee dryers and heat rolls such as flat calender rolls and emboss rolls. The temperature of the web per se may be measured by an infrared radiation thermometer, etc.

EXAMPLES

The present invention will now be explained in detail with reference to the examples. The measurement and definition of the physical values shown in the examples are first given below. Density:

A sample was prepared by the pressing process stipulated by JIS K-6758, and the density thereof was measured by the density gradient tube method provided in JIS K-7112.

Boiling n-Heptane-Insoluble Part:

Five (5) grams of polypropylene were completely dissolved in 500 ml of boiling xylene, and were then precipitated from 5 liters of methanol, followed by drying. Thereafter, the dried product was extracted with boiling n-heptane for 6 hours by Soxhlet extraction to obtain residues.

Isotactic Pentad Ratio ($P_o$) and Pentad Ratio ($P_2$) Having Two Different Kinds of Configurations:

Measurement was carried out with respect to the boiling n-heptane-insoluble part of polypropylene by the method described in Macromolecular 6, 925(1973). The assignments of peaks in NMR measurements was based on the method described on Macromolecules 8, 687 (1975). For such NMR measurements, an FT-NMRdevice of 270 MHz was used, and the signal detection limit was increased to 0.001 expressed in terms of the isotactic pentad ratio by the integrating measurement of 27,000 times.

MFR:

Measurement was carried out according to the condition (L) of ASTM D1238.

MFR of Polypropylene After Spinning:

Polypropylene alone was spun in the same amount of extrusion and under the same heating condition as in composite spinning to measure the MFR of the thus obtained sample.

MI:

Measurement was carried out according to the condition (E) of ASTM D 1238.

Spinnability:

Continuous spinning was carried out for one hour or longer to observe the occurrence of yarn breakage per spindle per hour.

O: No yarn breakage

Δ: Less than two yarn breakage x: At least two yarn breakage Bulk:

The required number of webs or nonwoven fabrics, each of 25 cm×25 cm, were collected in such a manner that the weight thereof totaled up to about 100 grams. After measuring the total weight of the webs or nonwoven fabrics, they were put one upon another. Placed on the obtained stack has a cardboard having an area of 25 cm×25 cm and weight of 75 grams to measure the overall height (h cm) and caluculate the volume (v $cm^3$) of the webs or nonwoven fabrics. Bulk was calculated from the following equation;

$$\text{Bulk} = v/w = 625 \times h/w (cm^3/g)$$

Degree of Bulk Retention:

The degree of bulk retention was found from the following equation;

$$\text{Degree of Bulk Retention} = (H/Ho) \times 100$$

wherein $H_o$ is the bulk of a web, and H is the bulk of a nonwoven fabric obtained from the same web.

Degree of Thermal Shrinkage of Web by the Heat-Treatment:

A parallel card web of 25 cm×25 cm was heat-treated in a loose state under conditions similar to those for the heat treatment for making nonwoven fabrics. Thereafter, the length (a cm) of the obtained nonwoven fabric in the direction of fiber orientation was measured. The degree of thermal shrinkage of the web was found from the following equation;

Degree of Thermal Shrinkage of Web=(-1−a/25)×100

EXAMPLES 1-8 & COMPARATIVE EXAMPLES 1-13

As shown in Table 1, various types of polypropylene (abbreviated as PP in Table 1) were used in combination with various types of polyethylene such as high-density polyethylene (abbreviated as HDPE in Table 1), low-density polyethylene (abreviated as LDPE in Table 1) and ethylene-vinyl acetate copolymers (abbreviated as EVA in Table 1) to obtain the H heat-adhesive composite fibers as well as other various composite fibers. The properties of these starting polymers as well as the spinning and stretching conditions are set out in Table 1. The spinning nozzles used had 60 holes of 1.0 mm in diameter for a nonstretched fiber fineness of 72 deniers, and 240 holes of 0.6 mm in diameter for a nonstretched fiber fineness of 24 deniers or less. In the sheath-core type composite structure, the sheath and core were formed of the second and first components, respectively.

The thus obtained nonstretched yarns were bundled to tows and stretched at the predetermined stretching temperature into stretched yarn tows in which three-dimensional crimps were developed, or were stretched at that temperature and additionally imparted two-dimensional crimps to the obtained stretched yarn tows. These tows were cut into a length of 64 mm to obtain composite short fibers, which were passed with or without other fibers through a 40-inch roller card to form card webs having a weight of 100 g/m$^2$. While the card webs were heated to the predetermined treatment temperature at a rate of 100° C./20 seconds by means of an air suction type dryer having an air pressure regulated to 0.12 g/cm$^2$, they were heat-treated for 30 seconds to make nonwoven fabrics.

Table 2 sets out the nonwoven fabric-making conditions and changes in volume of the webs at the time of nonwoven fabric-making.

Table 3 sets out the degree of bulk retention of the nonwoven fabrics obtained by treating the webs of Example 1 and Comparative Example 2 at an air pressure of 0.12 g/cm$^2$ and a treatment temperature of 145° C. with the use of an air suction dryer, but at varied rates of temperature rise, and varied heat treatment times.

From Tables 1 and 2, it is found that the bulky nonwoven fabrics obtained according to the present invention retain 50% and more of the bulk of the webs, even when the webs are heat-treated while an air pressure is applied thereto. Under conditions departing from the scope of the present invention, however, any bulky nonwoven fabrics are not obtained, since the bulk of the webs is reduced by heat treatment. More exactly, Comparative Examples 2, 4, 6, 7, 9 and 10 depart from the scope of the present invention with respect to the density, $P_o$ and $P_2$ of the first component; Comparative Examples 1, 5, 8, 11, 12 and 13 with respect to the MFR of the first component; Comparative Example 3 with respect to all the factors as mentioned just above; and Comparative Examples 14, 15 and 16 with respect to the density, $P_2$ and $P_o$ of the first component.

From Table 3, it is found that referring to the heating rate, bulky nonwoven fabrics can be obtained only when the webs obtained using the H heat-adhesive composite fibers are treated at a rate of temperature rise coming within the range of the present invention.

TABLE 1

| | First Component | | | | | | | Second Component | | Spinning Conditions | | | | | | |
|---|---|---|---|---|---|---|---|---|---|---|---|---|---|---|---|---|
| | Resin | Density ($g/cm^3$) | $P_0$ | $P_2$ | MFR Before Spinning/MFR After Spinning (g/10 min.) | MFR Difference | Melting Point (°C.) | Polymer Type (MI) | Melting Point (°C.) | Composit Structure | Composit Rate (1st Component/2nd Component (wt. %) | Spinning Temperature (1st Component/2nd Component) (°C.) | Fineness ($d/f^{*5}$) | Spinnability | Stretching Temperature (°C.) | Stretching Ratio | Crimp Form |
| Example 1 | PP | 0.911 | 0960 | <0.002 | 10.0/17.8 | 7.8 | 167 | HDPE (20) | 131 | Side-by-Side-Type | 50/50 | 250/200 | 24 | | 110 | 4.0 | Three-Dimensional Spiral |
| Comparative Example 1 | ↑ | ↑ | ↑ | ↑ | ↑/22.3 | 12.3 | ↑ | ↑ | ↑ | ↑ | ↑ | 290/200 | ↑ | | ↑ | ↑ | ↑ |
| Comparative Example 2 | ↑ | 0.900 | 0.935 | 0.018 | 9.8/17.5 | 7.7 | 162 | ↑ | ↑ | ↑ | ↑ | 250/200 | ↑ | | ↑ | ↑ | ↑ |
| Comparative Example 3 | ↑ | ↑ | ↑ | ↑ | ↑/23.0 | 13.2 | ↑ | ↑ | ↑ | ↑ | ↑ | 290/200 | ↑ | | ↑ | ↑ | ↑ |
| Example 2 | ↑ | 0.911 | 0.960 | <0.002 | 10.0/17.8 | 7.3 | 167 | ↑ | ↑ | ↑ | 60/40 | 250/200 | ↑ | | 90 | 3.8 | Two-Dimensional Digzag |
| Comparative Example 4 | ↑ | 0.900 | 0.935 | 0.018 | 9.8/17.2 | 7.4 | 162 | ↑ | ↑ | ↑ | 60/40 | ↑ | ↑ | | ↑ | ↑ | ↑ |
| Example 3 | ↑ | 0.910 | 0.975 | <0.002 | 18.1/26.0 | 7.9 | 167 | ↑ | ↑ | ↑ | 50/50 | ↑ | 12 | | 110 | 4.0 | Three-Dimensional Spiral |
| Comparative Example 5 | ↑ | ↑ | ↑ | ↑ | ↑/32.2 | 14.1 | ↑ | ↑ | ↑ | ↑ | ↑ | 280/200 | ↑ | | ↑ | ↑ | ↑ |
| Comparative Example 6 | ↑ | 0.903 | 0.972 | 0.006 | 17.6/25.6 | 8.0 | 163 | ↑ | ↑ | ↑ | ↑ | 250/200 | ↑ | | ↑ | ↑ | ↑ |
| Example 4 | ↑ | 0.911 | 0.960 | <0.002 | 10.0/18.0 | 8.0 | 167 | HDPE (15) | ↑ | Sheath-Core Type | 40/60 | 250/200 | 24 | | 90 | ↑ | Two-Dimensional Digzag |
| Comparative Example 7 | ↑ | 0.900 | 0.935 | 0.018 | 9.8/17.8 | 8.0 | 162 | ↑ | ↑ | ↑ | ↑ | ↑ | ↑ | | ↑ | ↑ | ↑ |
| Example 5 | ↑ | 0.913 | 0.964 | <0.002 | 4.9/9.9 | 5.0 | 168 | HDPE (20) | ↑ | Side-by-Side Type | 50/50 | ↑ | 72 | | 110 | 4.0 | Three-Dimensional Spiral |
| Comparative Example 8 | ↑ | ↑ | ↑ | ↑ | ↑/17.0 | 12.1 | ↑ | ↑ | ↑ | ↑ | ↑ | ↑ | ↑ | | ↑ | ↑ | ↑ |
| Comparative Example 9 | ↑ | 0.902 | 0.919 | 0.025 | 4.9/10.1 | 5.2 | 162 | ↑ | ↑ | ↑ | ↑ | ↑ | ↑ | | ↑ | ↑ | ↑ |
| Example 6 | ↑ | 0.913 | 0.964 | <0.002 | 4.9/9.9 | 5.0 | 168 | HDPE/LDPE*2 | 131/104 | Sheath-Core Type | ↑ | 250/240 | ↑ | | 90 | 3.8 | Two-Dimensional |

TABLE 1-continued

| | First Component | | | | | | | Second Component | | Spinning Conditions | | | | | | | |
|---|---|---|---|---|---|---|---|---|---|---|---|---|---|---|---|---|---|
| | Resin | Density ($g/cm^3$) | $P_0$ | $P_2$ | MFR Before Spinning/MFR After Spinning (g/10 min.) | MFR Difference | Melting Point (°C.) | Polymer Type (MI) | Melting Point (°C.) | Composit Structure | Composit Rate (1st Component/2nd Component (wt. %) | Spinning Temperature (1st Component/2nd Component) (°C.) | Fineness (d/f*5) | Spinnability | Stretching Temperature (°C.) | Stretching Ratio | Crimp Form |
| Comparative Example 10 | ↑ | 0.902 | 0.919 | 0.025 | 4.9/10.1 | 5.2 | 162 | ↑ | ↑ | ↑ | ↑ | ↑ | ↑ | | ↑ | ↑ | Digzag ↑ |
| Example 7 | PP*1 | 0.913 | 0.964 | <0.002 | 4.9/10.9 | 5.0 | 168 | HDPE (22)*3 | 131 | Side-by-Side Type | ↑ | 250/200 | ↑ | | 110 | 4.0 | Three-Dimensional Spiral |
| Example 8 | PP | 0.910 | 0.975 | <0.002 | 18.1/26.0 | 7.9 | 167 | EVA*4 | 102 | Sheath-Core Type | ↑ | 250/180 | 12 | | 90 | 3.5 | Two-Dimensional Digzag |
| Comparative Example 11 | ↑ | 0.912 | 0.968 | <0.002 | 2.8/6.8 | 4.0 | 168 | HDPE (20) | 131 | ↑ | ↑ | 290/200 | 72 | X | — | — | — |
| Comparative Example 12 | ↑ | ↑ | ↑ | ↑ | ↑/13.2 | 10.4 | ↑ | ↑ | ↑ | ↑ | ↑ | 350/200 | ↑ | Δ | 90 | 3.8 | Two-Dimensional Digzag |
| Comparative Example 13 | ↑ | 0.910 | 0.973 | ↑ | 22.0/28.9 | 6.9 | 167 | ↑ | ↑ | Side-by-Side Type | ↑ | 250/200 | 12 | | 110 | 4.0 | Three-Dimensional Spiral |
| Comparative Example 14 | ↑ | 0.909 | 0.975 | 0.005 | 11.0/18.0 | 7.0 | 163 | ↑ | ↑ | ↑ | ↑ | ↑ | 24 | | ↑ | ↑ | ↑ |
| Comparative Example 15 | ↑ | 0.903 | 0.964 | <0.002 | 10.4/18.8 | 8.4 | ↑ | ↑ | ↑ | ↑ | ↑ | ↑ | ↑ | | ↑ | ↑ | ↑ |
| Comparative Example 16 | ↑ | 0.910 | 0.945 | ↑ | 9.8/18.9 | 8.2 | ↑ | ↑ | ↑ | ↑ | ↑ | ↑ | ↑ | | ↑ | ↑ | ↑ |

*1Containing 5% of Halogen base fire retardant
*2 50% mixed product of HDPE and LDPE, each having MI of 10.0
*3Containing 5% of Halogen base fire retardant
*4Vinyl Acetate Content of 5% by weight
*5deniers per filament

TABLE 2

| | Conditions for Making Nonwoven Fabric | | | | | | | Changes in Volume at the Time of Making Nonwoven Fabric | | | |
|---|---|---|---|---|---|---|---|---|---|---|---|
| | Composit Fibers | | Other Fibers | | | | Nonwoven | Bulk | | Degree of | Degree of |
| | Fineness × Length (d/f) × (mm) | Blending Proportion (wt. %) | Types | Fineness × Length (d/f) × (mm) | Blending Proportion (wt. %) | Treating Temperature (°C.) | Fabric Weight ($g/m^2$) | Web ($H_o$) ($cm^3/g$) | Nonwoven Fabric (H) ($cm^3/g$) | Bulk Retention (%) | Thermal Shrinkage of Web (%) |
| Example 1 | 6 × 64 | 100 | — | — | — | 145 | 102 | 108 | 70 | 65 | 0 |
| Comparative Example 1 | ↑ | ↑ | — | — | — | ↑ | 107 | 121 | 40 | 33 | 1 |
| Comparative Example 2 | ↑ | ↑ | — | — | — | ↑ | 108 | 119 | 25 | 21 | 3 |
| Comparative Example 3 | ↑ | ↑ | — | — | — | ↑ | 110 | 122 | 22 | 18 | 3 |
| Example 2 | 7.5 × 64 | 25 | *1PET | 6 × 64 | 75 | ↑ | ↑ | 114 | 65 | 57 | 2 |
| Comparative Example 4 | ↑ | ↑ | ↑ | ↑ | ↑ | ↑ | 115 | 100 | 30 | 30 | 6 |
| Example 3 | 3 × 64 | 100 | — | — | — | 135 | 96 | 103 | 65 | 63 | 0 |
| Comparative Example 5 | ↑ | ↑ | — | — | — | ↑ | 102 | 124 | 41 | 37 | 0 |
| Comparative Example 6 | ↑ | ↑ | — | — | — | ↑ | 100 | 144 | 23 | 16 | 2 |
| Example 4 | ↑ | ↑ | — | — | — | 145 | 106 | 92 | 55 | 60 | 0 |
| Comparative Example 7 | ↑ | ↑ | — | — | — | ↑ | 118 | 106 | 19 | 18 | 0 |
| Example 5 | 18 × 64 | ↑ | — | — | — | ↑ | 115 | 114 | 75 | 66 | 0 |
| Comparative Example 8 | ↑ | ↑ | — | — | — | ↑ | 118 | 118 | 42 | 36 | 0 |
| Comparative Example 9 | ↑ | ↑ | — | — | — | ↑ | 120 | 124 | 31 | 25 | 0 |
| Example 6 | 20 × 64 | 50 | *2PP | 18 × 64 | 50 | ↑ | 118 | 93 | 50 | 54 | 3 |
| Comparative Example 10 | ↑ | ↑ | ↑ | ↑ | ↑ | ↑ | 122 | 114 | 16 | 14 | 8 |
| Example 7 | 18 × 64 | 100 | — | — | — | ↑ | 110 | 110 | 66 | 60 | 0 |
| Example 8 | 3.5 × 64 | ↑ | — | — | — | 130 | 98 | 103 | 61 | 59 | 0 |
| Comparative Example 11 | — | — | — | — | — | — | — | — | — | — | — |
| Comparative Example 12 | 20 × 64 | 100 | — | — | — | 145 | 120 | 108 | 43 | 40 | 2 |
| Comparative Example 13 | 3 × 64 | ↑ | — | — | — | 135 | 110 | 103 | 40 | 39 | 0 |
| Comparative Example 14 | 6 × 64 | ↑ | — | — | — | 145 | 106 | 108 | 42 | 39 | 1 |
| Comparative Example 15 | ↑ | ↑ | — | — | — | ↑ | 102 | 100 | 38 | 38 | 0 |
| Comparative Example 16 | ↑ | ↑ | — | — | — | ↑ | 110 | 110 | 36 | 33 | 2 |

*1Polyethylene Terephthalate,
*2Usual polypropylene

TABLE 3

| | Rate of Temperature Rise | | | | | | | | | |
|---|---|---|---|---|---|---|---|---|---|---|
| | 100° C./5 sec. | | 100° C./15 sec. | | 100° C./25 sec. | | 100° C./40 sec. | | 100° C./50 sec. | |
| | Treatment Time (sec.) | Degree of Bulk Retention (%) | Treatment Time (sec.) | Degree of Bulk Retention (%) | Treatment Time (sec.) | Degree of Bulk Retention (%) | Treatment Time (sec.) | Degree of Bulk Retention (%) | Treatment Time (sec.) | Degree of Retention (%) |
| Web of Example 1 | 30 | 68 | 30 | 63 | 40 | 59 | 40 | 40 | 30 | 23 |
| Web of Comparative Example 2 | 30 | 25 | 30 | 21 | 40 | 20 | 40 | 19 | 30 | 19 |

EFFECT

In accordance with the present invention, bulky nonwoven fabrics can be obtained by heat-treating webs obtained using the specifically limited heat-adhesive composite fibers, even when the webs are heat-treated with the application of an air pressure. It is thus possible to easily carry out the highly efficient production of nonwoven fabrics with a suction dryer which will enjoy wide use from now on.

What is claimed is:

1. A method for making nonwoven fabrics which comprises the steps:

melt-spinning first and second components to obtain heat-adhesive composite fibers and crimping thereafter, said first component being polypropylene having a density of 0.905 g/cm$^3$ or higher, and having a boiling n-heptane-insoluble part whose isotactic pentad ratio is 0.950 or higher and those pentad ratio having two different kinds of configurations is 0.002 or lower, and said second component being a polymer composed mainly of polyethylene, said first and second components being of the side-by-side or sheath-core arrangement in which said second component is formed on at least a part of the surfaces of said fibers in a lengthwise continuous manner, and said first component showing a melt flow rate of 3 inclusive to 20 exlusive before melt-spinning and a difference of within 10 between the melt flow rates before and after melt-spinning;

forming a web consisting of said composite fibers alone or containing at least 20% by weight of said composite fibers; and heat-treating said web at a treatment temperature equal to or higher than the melting point of said second component but lower than the melting point of said first component, while increasing the temperature of said web at a rate of 100° C./30 seconds or higher to avoid a relaxation of molecular orientation of said first component given during spinning and stretching thereof.

2. The method of claim 1, wherein said first component has a density greater than 0.910 g/cm$^3$.

3. The method of claim 1, wherein said second component is a homopolymer of ethylene.

4. The method of claim 1, wherein said second component is a copolymer of ethylene with at least one member selected from the group consisting of propylene, 1-butene, and vinylacetate.

5. The method of claim 1, wherein said second component is a mixture of ethylene polymers.

6. The method of claim 1, wherein said second component has a melting point of at least 20° C. less than the melting point of said first component.

7. The method of claim 1, wherein said second component has a melt index of from about 5 to about 35.

8. The method of claim 1, wherein said composite fibers contain said second component in an amount of from 40 to 70% by weight.

9. The method of claim 1, wherein said web contains said composite fibers in an amount of at least 30% by weight.

* * * * *